US007387003B2

(12) United States Patent
Marszalek et al.

(10) Patent No.: US 7,387,003 B2
(45) Date of Patent: Jun. 17, 2008

(54) APPARATUS, A SYSTEM AND A METHOD FOR SECURING A DEVICE TO A FIXTURE

(75) Inventors: Christopher Marszalek, Plainfield, IL (US); Daniel Horvath, Marseilles, IL (US)

(73) Assignee: Sennco Solutions, Inc, Plainfield, IL (US)

( * ) Notice: Subject to any disclaimer, the term of this patent is extended or adjusted under 35 U.S.C. 154(b) by 241 days.

(21) Appl. No.: 10/861,052

(22) Filed: Jun. 3, 2004

(65) Prior Publication Data

US 2005/0268674 A1 Dec. 8, 2005

(51) Int. Cl.
*E05B 69/00* (2006.01)

(52) U.S. Cl. ..... 70/58; 70/14; 70/49; 248/551

(58) Field of Classification Search ..... 70/14, 70/30, 49, 58; 211/4, 7, 57.1, 59.1, 94; 248/551–553
See application file for complete search history.

(56) References Cited

U.S. PATENT DOCUMENTS

| | | | | | |
|---|---|---|---|---|---|
| 1,921,434 | A * | 8/1933 | Stone | 70/259 |
| 3,765,196 | A * | 10/1973 | Balicki | 70/49 |
| 3,785,183 | A * | 1/1974 | Sander | 70/58 |
| 3,859,826 | A * | 1/1975 | Singer et al. | 70/58 |
| 4,719,773 | A * | 1/1988 | Alberts | 70/18 |
| 4,869,084 | A * | 9/1989 | Mack, Jr. | 70/259 |
| 5,050,836 | A * | 9/1991 | Makous | 248/553 |
| 5,197,706 | A * | 3/1993 | Braithwaite et al. | 248/499 |
| 5,341,124 | A * | 8/1994 | Leyden et al. | 340/568.4 |
| 5,351,507 | A * | 10/1994 | Derman | 70/18 |
| 5,421,667 | A * | 6/1995 | Leyden et al. | 403/300 |
| 5,676,258 | A | 10/1997 | Leyden et al. | |
| 5,709,110 | A * | 1/1998 | Greenfield et al. | 70/58 |
| 6,039,498 | A * | 3/2000 | Leyden et al. | 403/61 |
| 6,087,939 | A * | 7/2000 | Leyden et al. | 340/568.2 |
| 6,212,919 | B1 * | 4/2001 | Gerow | 70/18 |
| 6,212,922 | B1 * | 4/2001 | Miao | 70/58 |
| 6,244,082 | B1 * | 6/2001 | Avganim | 70/58 |
| RE37,590 | E * | 3/2002 | Leyden et al. | 340/568.1 |
| 6,386,906 | B1 * | 5/2002 | Burke | 439/501 |
| 6,578,394 | B2 * | 6/2003 | Yin | 70/58 |
| 6,690,277 | B1 * | 2/2004 | Hansen et al. | 340/568.2 |
| 7,021,091 | B2 * | 4/2006 | Leyden et al. | 70/18 |

* cited by examiner

*Primary Examiner*—Suzanne Dino Barrett
(74) *Attorney, Agent, or Firm*—Patents + TMS, P.C.

(57) ABSTRACT

An apparatus, a system and a method secure, mount and/or attach a device to a fixture. The apparatus has an arm, a housing, a cable, and/or a locking member. The arm has a bracket which attaches to the device. The arm inserts into a housing and/or an opening in a head. A cable connects the head to a base which attaches to the fixture. A locking member receives the arm and/or locks the device to the cable, the base and/or the fixture. The cable extends outward with respect to a fixture allowing the device to be manipulated, to be examined and/or to be utilized by a person while the device remains secured to the fixture.

16 Claims, 7 Drawing Sheets

APPARATUS, A SYSTEM AND A METHOD FOR SECURING A DEVICE TO A FIXTURE

BACKGROUND OF THE INVENTION

The present invention generally relates to an apparatus, a system and a method for securing a device. More specifically, the present invention relates to an apparatus, a system and a method for securing a device to a fixture. The device may be a portable electronic device, such as, for example, a laptop computer, a cellular phone, a portable compact disc player, a portable MP3 player, a personal data assistant and/or the like. The apparatus, the system and the method for securing the device may attach the device to a fixture to prevent theft of, damage to and/or destruction of the device. The fixture may be, for example, a table, a shelf, a display unit, a display cabinet and/or the like.

The apparatus, the system and the method for securing a device may have an arm, a housing, a cable, and/or a locking member. The arm may have a first end and/or a second end. The first end may have a bracket which may be attached the device. The cable may have a first end and/or a second end. The second end may be opposite to the first end of the cable. The first end of the cable may be connected to the bracket. The second end of the cable may be attached to the fixture. As a result, the device may be manipulated, may be examined and/or may be utilized by a person while remaining secured to the fixture.

It is generally known that, for example, a vendor, a wholesaler and/or a retailer displays portable electronic devices in showrooms. The vendor, the wholesaler and/or the retailer have other units of the portable electronic devices in storage for sale to customers. The portable electronic devices are, for example, laptop computers, cellular phones, portable compact disc players, portable MP3 players and/or personal data assistants. Often, the customers examine and/or utilize the portable electronic devices on display before deciding to purchase one of the units of the portable electronic devices from the vendor, the wholesaler and/or the retailer. The vendor, the wholesaler and/or the retailer secures the portable electronic devices to fixtures in the showroom to prevent theft of the devices by the customers. The devices on display may be secured to the fixtures by cables and/or assemblies. Traditionally, the cables may be thin which may allow the cables to be easily cut and/or the devices to be easily separated from the fixtures. The assemblies attach and/or lock the devices to the fixtures. The assemblies may be easily disassembled and/or may allow the devices to be easily separated from the fixtures. Further, the cables and/or the assemblies prohibit the customers from lifting, manipulating and/or examining the devices on display in the showrooms. Still further, the cables and/or the assemblies are expensive, complicated to assemble and/or are ineffective in securing the devices to the fixtures. Moreover, the cables and/or the assemblies fail to prevent the device from being separated from the fixtures. As a result, the cables and/or the assemblies are ineffective in preventing the theft of and/or the destruction of the devices on display by the customers.

Often, the assemblies secure the devices, such as, for example, laptop computers to the fixtures with rods. The rods extend across the laptop computers and attach to the fixtures. As a result, the laptop computers are secured between the rods and the fixtures. However, the rods prohibit the customers from lifting the laptop computers from the fixtures for examination. The laptop computers can only be lifted from the fixtures by detaching the rods and/or separating the laptop computers from the fixtures. As a result, a person can not examine and/or utilize the laptop computers while the laptop computer connected to the fixtures.

A need, therefore, exists for an apparatus, a system and a method for securing a portable electronic device to a fixture. Additionally, a need exists for an apparatus, a system and a method for securing the device to the fixture to prevent the device from being separated from the fixture. Further, a need exists for an apparatus, a system and a method for securing the device to the fixture which may allow the device to be attached to the fixture via a cable. Still further, a need exists for an apparatus, a system and a method for securing the device to the fixture which may allow the device to be lifted off the top surface of the fixture for examination while remaining connected to the fixture. Moreover, a need exists for an apparatus, a system and a method for securing the device to the fixture which may be easy to assemble and/or may be inexpensive.

SUMMARY OF THE INVENTION

The present invention generally relates to an apparatus, a system and a method for securing a device to a fixture. More specifically, the present invention relates to an apparatus, a system and a method for securing a portable electronic device to a fixture. The apparatus may have an arm, a bracket, a housing, a cable, and/or a locking member. The bracket may be attached to the device and/or may be connected to the cable. A joint may be located between the cable and the bracket and/or the device. The cable may be attached to the fixture. The locking member may secure the device the cable and/or may attach the bracket to the cable. As a result, the device may be secured to the fixture.

To this end, in an embodiment of the present invention, an apparatus for securing a device to a fixture is provided. The apparatus has a bracket having a front side and a backside opposite to the front side wherein the bracket attaches to the device. Further, the apparatus has a cable having a length defined between a first end and a second end wherein the cable connects the bracket to the fixture. Moreover, the apparatus has a lock attached to the bracket wherein the cable is between the bracket and the lock.

In an embodiment, the apparatus has an arm extending from the bracket through the cable to the lock.

In an embodiment, the apparatus has a housing covering the bracket.

In an embodiment, the apparatus has a stopper attached to the cable.

In an embodiment, the apparatus has a connector attaching the bracket to the device.

In an embodiment, the apparatus has a base between the cable and the fixture.

In an embodiment, the apparatus has a pin connecting the cable to the bracket.

In an embodiment, the apparatus has a plurality of mounts attaching the cable to the fixture.

In another embodiment of the present invention, a system for securing a device is provided. The system has a cable having a length defined between a first end and a second end. Further, the system has a fixture having a surface wherein the second end of the cable is connected to the fixture. Still further, the system has a first attaching means that connects the device to the first end of the cable and further wherein the first attaching means extends away from the device. Moreover, the system has a lock attached to the first attaching means wherein the locks secures the device to the fixture.

In an embodiment, the system has a housing covering the first attaching means.

In an embodiment, the system has a second attaching means for attaching the device to the cable.

In an embodiment, the system has a stopper attaching the cable to the fixture.

In an embodiment, the system has a pin attaching the cable to the first attaching means.

In an embodiment, the system has a sleeve attaching the cable to the fixture.

In another embodiment of the present invention, a method for displaying a device on a fixture having a surface is provided. The method has the step of providing a bracket having a front side, a backside and an arm wherein the front side is opposite to the backside and further wherein the arm extends outward with respect to the backside. Further, the method has the step of attaching the bracket to the device wherein the front side of the bracket is adjacent to the device. Still further, the method has the step of connecting a cable between the arm and the fixture. Moreover, the method has the step of attaching a lock to the arm wherein the cable connects to the arm between the lock and the bracket and further wherein the lock secures the device to the fixture.

In an embodiment, the method has the step of setting the device on the surface of the fixture.

In an embodiment, the method has the step of removing the lock from the arm.

In an embodiment, the method has the step of rotating the device with respect to the cable.

In an embodiment, the method has the step of attaching the cable to the fixture.

In another embodiment, an apparatus for attaching a device to a fixture is provided. The apparatus has a cable having a first end and a second end opposite to the first end wherein the first end is attached to the fixture and further wherein the second end extends away from the fixture. Further, the apparatus has an opening in the cable wherein the opening extends through the cable and further wherein the opening is adjacent to the second end of the cable. Moreover, the apparatus has an attaching means having a first end and a second end opposite to the first end wherein the attaching means is inserted into the opening in the cable wherein the first end of the attaching means extends away from the cable and further wherein the device attaches to the first end of the attaching means.

In an embodiment, the apparatus has a stopper attached to first end of the cable.

In an embodiment, the apparatus has a pin between first end of the attaching means and the first end of the cable.

In an embodiment, the apparatus has a lock attached to the second end of the attaching means.

In another embodiment of the present invention, a method for attaching a device to a fixture having a cable wherein the cable extends away from the fixture is provided. The method has the step of providing an attaching means on the cable wherein the attaching means extends through the cable and further wherein the attaching means extends away from the cable. Moreover, the method has the step of attaching the device to the cable via the attaching means.

In an embodiment, the method has the step of attaching a lock to the cable.

In an embodiment, the method has the step of inserting the attaching means into the device.

In an embodiment, the method has the step of rotating the device with respect to the cable.

It is, therefore, an advantage of the present invention to provide an apparatus, a system and a method for securing a device to a fixture to prevent theft of and/or destruction of the device.

Another advantage of the present invention is to provide an apparatus, a system and a method for securing a device to a fixture which may prevent separation of the device from the fixture.

And, another advantage of the present invention is to provide an apparatus, a system and a method for securing a device to a fixture which may be easy to assemble and/or may be easily attached to the device.

Yet another advantage of the present invention is to provide an apparatus, a system and a method for securing a device to a fixture which provides a first connector and/or a second connector for attachment to a monitor port and/or a security port of the device.

A further advantage of the present invention is to provide an apparatus, a system and a method for securing a device to a fixture which provides a housing to secure the device to a cable and/or the fixture.

Moreover, an advantage of the present invention is to provide an apparatus, a system and a method for securing a device to a fixture which provides a groove in a top surface of the fixture for securing the device to the fixture.

And, another advantage of the present invention is to provide an apparatus, a system and a method to secure a device to a fixture which provides a cable to allow the device to be lifted off a top surface of the fixture while the device remains secured to the fixture.

Yet another advantage of the present invention is to provide an apparatus, a system and a method for securing a device to a fixture which provides a cable resistant to cutting and/or to breaking.

Another advantage of the present invention is to provide an apparatus, a system and a method for securing a device to a fixture which provides a mount attached to a top surface of the fixture.

Yet another advantage of the present invention is to provide an apparatus, a system and a method for securing a device to a fixture which provides a lock to secure the device to the fixture.

A still further advantage of the present invention is to provide an apparatus, a system and a method for securing a device to a fixture which allows the device to be attached to the fixture via a security port of the device.

Moreover, an advantage of the present invention is to provide an apparatus, a system and a method for securing a device to a fixture which allows a laptop computer to be secured to the fixture.

And, another advantage of the present invention is to provide an apparatus, a system and a method for securing a device to a fixture which provides a plurality of fasteners to attach the device to the fixture.

Yet another advantage of the present invention is to provide an apparatus, a system and a method for securing a device to a fixture which allows a person to examine the device by lifting the device off a top surface of the fixture.

A further advantage of the present invention is to provide an apparatus, a system and a method for securing a device to a fixture which provides a pin between the device and the fixture.

Moreover, an advantage of the present invention is to provide an apparatus, a system and a method for securing a device to a fixture which allows the device to be rotated with respect to a cable via a pin between the device and the cable.

A still further advantage of the present invention is to provide an apparatus, a system and a method for securing a device to a fixture which allows a person to manipulate the device by lifting the device off the fixture while the device remains secured to the fixture.

Yet another advantage of the present invention is to provide an apparatus, a system and a method for securing a device to a fixture which allows a lock and/or a key to secure the device to the fixture.

A still further advantage of the present invention is to provide an apparatus, a system and a method for securing a device to a fixture allows a person to examine a weight of the device and/or to view all sides of the devices without detaching the device from the fixture.

Moreover, an advantage of the present invention is to provide an apparatus, a system and a method for securing a device to a fixture which provides a cable customized for a retailer.

Additional features and advantages of the present invention are described in, and will be apparent from, the detailed description of the presently preferred embodiments and from the drawings.

DETAILED DESCRIPTION OF THE PREFERRED EMBODIMENTS

The present invention generally relates to an apparatus, a system and a method for securing a device to a fixture. The apparatus may be attached to the device. Further, the apparatus may be mounted to the fixture via a cable. As a result, the device may be secured to and/or may be attached to the fixture.

Figure 1:
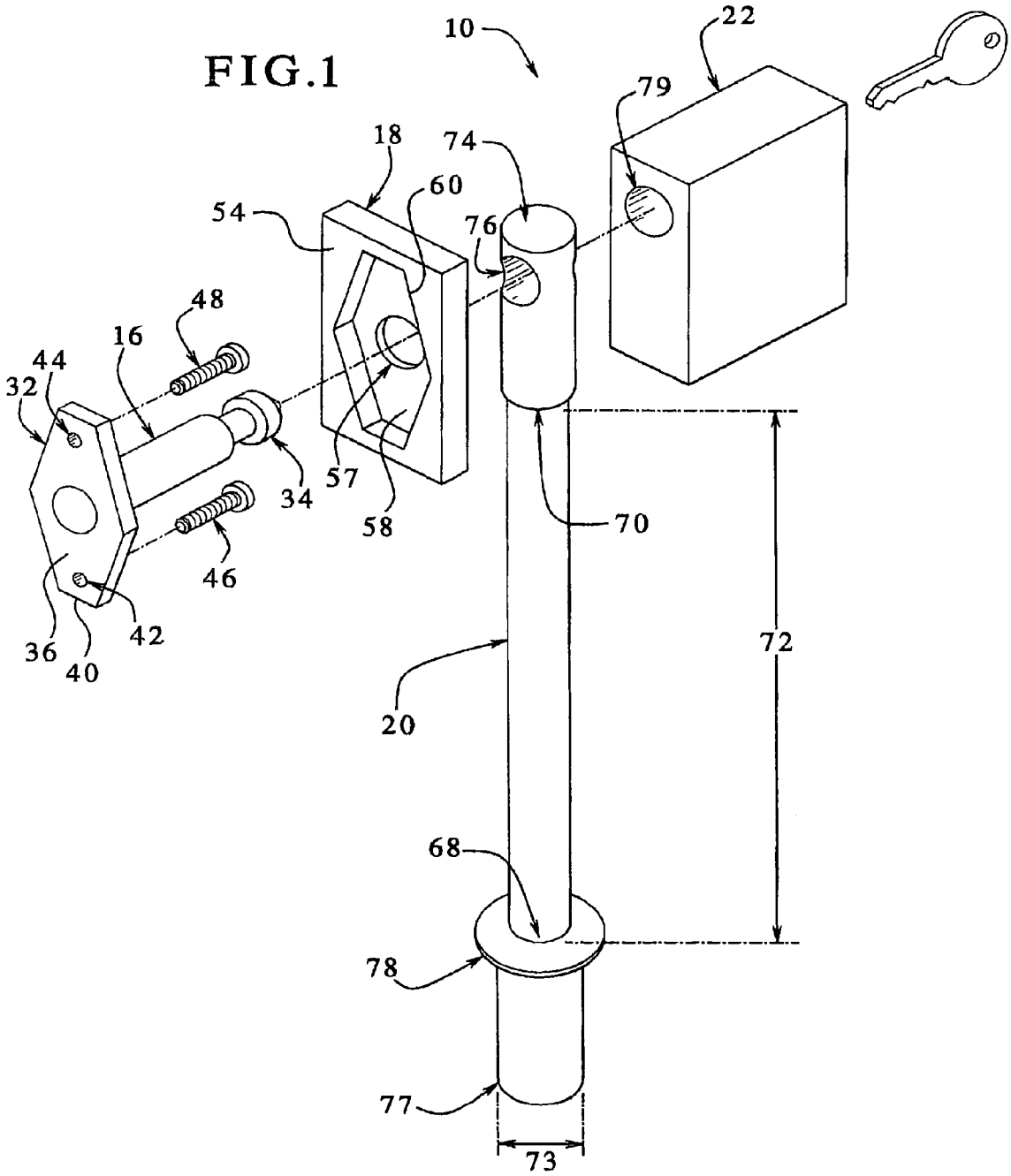
FIG. 1 is an exploded perspective view of an apparatus for securing a device to a fixture in an embodiment of the present invention.
Figure 2:
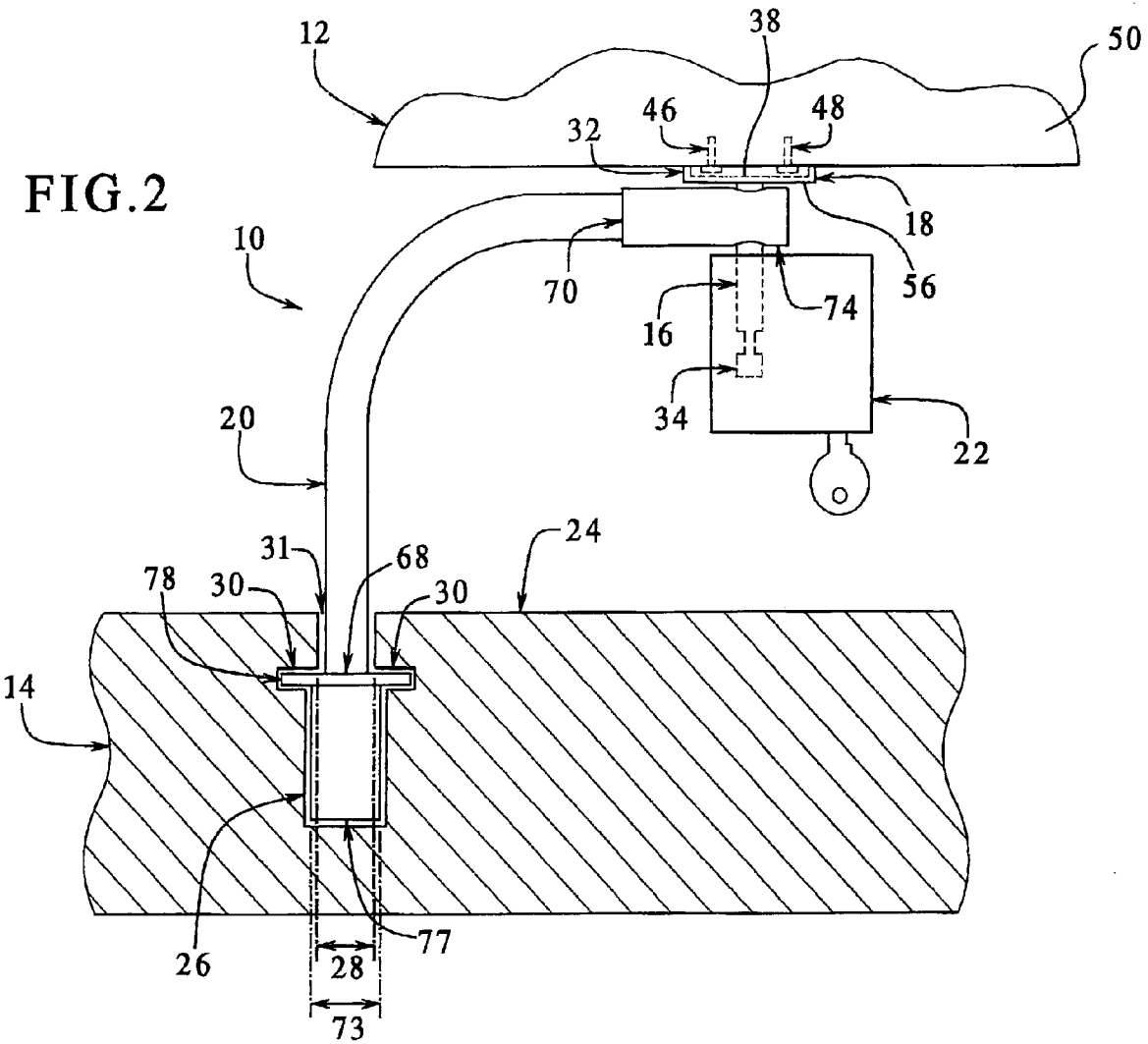
FIG. 2 is a side plan view of an apparatus for securing a device to a fixture in an embodiment of the present invention.

Referring now to the drawings wherein like numerals refer to like parts, FIGS. 1 and 2 illustrate an apparatus 10 which may secure a device 12 to a fixture 14 in an embodiment of the present invention. The apparatus 10 may have an arm 16, a housing 18, a cable 20, and/or a locking member 22. Further, the fixture 14 may have a top surface 24, a groove 26, a lip 30 and/or an opening 31. The opening 31 may have a diameter 28. The device 12 may be a portable device, such as, for example, a laptop computer, a cellular phone, a portable compact disc player, a portable MP3 player, a personal data assistant, a camera, a digital camera, a video recorder and/or the like. The fixture 14 may be, for example, a table, a shelf, a display unit and/or the like. The present invention should not be deemed as limited to a specific device 12 and/or a specific fixture 14.

The arm 16 may have a bracket 32 and/or a tip 34 that may be opposite to the bracket 32. The bracket 32 may have a front side 36, a backside 38, a perimeter 40, a first mounting hole 42 and/or a second mounting hole 44. The backside 38 may be opposite to the front side 36. The first mounting hole 42 and/or the second mounting hole 44 may extend through the bracket 32 from the first side 36 to the backside 38 of the bracket 32. A first connector 46 and/or a second connector 48 may be inserted into the first mounting hole 42 and/or the second mounting hole 44, respectively. The first connector 46 and/or the second connector 48 may extend outward with respect to the front side 36 of the bracket 32. The first connector 46 and/or the second connector 48 may attach the bracket 32 and/or the arm 16 to the device 12. The first connector 46 and/or the second connector 48 may attach to an exterior 50 of the device 12. The first connector 46 and/or the second connector 48 may be, for example, a screw, a bolt, a hook and/or the like. The arm 16 may be integrally formed with the bracket 32 and/or the tip 34. The arm 16, the bracket 32 and/or the tip 34 may be made from a material, such as, for example, steel and/or the like. The present invention should not be deemed as limited to a specific first connector 46 and/or a specific second connector 48 and/or a specific material of the arm 16, the bracket 32 and/or the tip 34.

As shown in FIGS. 1 and 2, the housing 18 may have a front side 54, a second side 56 and/or a passage 57. The front side 54 may be opposite to the second side 56. The front side 56 may have a recession 58 which may have a perimeter 60. The passage 57 may extend through the housing 18 from the front side 54 to the second side 56 of the housing 18. Further, the passage 57 may be located within the perimeter 60 of the recession 58. The tip 34 of the arm 16 may be inserted through the passage 57 of the housing 18. The tip 34 of the arm 16 may extend outward with respect to the second side 56 of the housing 18.

The perimeter 60 of the recession 58 may recieve the perimeter 40 of the bracket 32. As a result, the bracket 32 may be inserted into the recession 58. The backside 38 of the bracket 32 may abut the first side 56 and/or the recession 58 of the housing 18. As a result, the bracket 32 may be enclosed between the housing 18 and the device 12. The housing 18 may cover the first connector 46 and/or the second connector 48. The housing 18 may prevent access to the first connector 46 and/or the second connector 48 As a result, the housing 18 may prevent the first connector 46 and/or the second connector 48 from being removed from the bracket 32 and/or the device 12. The housing 18 may be made from a material, such as, for example, steel and/or the like. The present invention should not be deemed as limited to a specific material of the housing 18.

A cable 20 may have a first end 68, a second end 70 and/or a length 72 as illustrated FIGS. 1 and 2. The second end 70 may be opposite to the first end 68. The second end 70 may be attached to a head 74. The head 74 may have an opening 76. The opening 76 may extend through the head 74. The first end 68 may be attached to a stopper 77 and/or a shoulder 78. The stopper 77 and/or the shoulder 78 may have a diameter 73. The cable 20 may be made from a material, such as, for example, steel, galvanized steel and/or the like. The length 72 of the cable 20 may be, for example, six inches, twelve inches or eighteen inches. The head 74, the shoulder 78, the stopper 77 may be made from a material, such as, for example, steel and/or the like. The present invention should not be deemed as limited to a specific material of the cable 20, the head 74, the shoulder 78 and/or the stopper 77, a specific length of the cable 20 and/or a specific diameter of the shoulder 78.

As illustrated in FIG. 2, the shoulder 78 and/or the stopper 77 may be inserted into the groove 26, the opening 31 and/or the lip 30 of the fixture 14. The diameter 28 of the opening 31 may be less than the diameter 73 of the stopper 77. As a result, the opening 31 may prevent the shoulder 78 and/or the stopper 77 from being removed therefrom. The shoulder 78 may be adjacent to the lip 30 and/or the opening 31. As a result, the stopper 77 and/or the shoulder 78 may be secured to the fixture 14 via the lip 30 and/or the opening 31 of the fixture 14. Further, the cable 20 may be attached to the fixture 14 via the shoulder 78, and/or the stopper 77, the groove 26, the lip 30 and/or the opening 31 of the fixture 14. Moreover, the cable 20 may extend outward with respect to the top surface 24 and/or the opening 31 of the fixture 14.

The tip 34 of the arm 16 may be inserted through the opening 76 of the head 74 as illustrated in FIGS. 1 and 2. As a result, the second side 56 of the housing 18 may be adjacent to the opening 76 and/or the head 74. The tip 34 of the arm 16 may extend outward with respect to the head 74. Further, the device 12, the arm 16, the bracket 32 and/or the housing 18 may be connected to the cable 20, the head 74, the stopper 77 and/or the fixture 14 via the opening 76 of the head 74. Still further, the tip 34 of the arm 16 may be inserted into a lock hole 79 of the locking member 22. The locking member 22 may be a lock, such as, for example, a padlock, lock having a key 81, a combination lock and/or the like. The locking member 22 may be engaged by, for example, turning the key 81 and removing the key 81 from the locking member 22. The tip 34 of the arm 16 may be locked inside the lock hole 79 of the locking member 22. As a result, the device 12 and/or the arm 16 may be secured to the locking member 22. Moreover, the device 12 may be attached to and/or may be secured to the cable 20, the head 74, the bracket 32, the arm 16, the locking member 22 and/or the fixture 14. It should be understood that the locking member 22 may be any lock that may be implemented by one having ordinary skill in the art. The present invention should not be deemed as limited to the embodiment of a specific locking member 22.

A user (not shown in the drawings) may connect the device 12 to the apparatus 10 and/or the fixture 14. The user may attach and/or may lock the device 12 to the apparatus 10 via the arm 16 and/or the locking member 22. Further, the user may attach the apparatus 10 and/or the device 12 to the fixture 14 via the cable 20 and the opening 31 of the fixture 14. As a result, the user may secure the device 12 to the fixture 14. Still further, the user may detach the locking member 22 and/or the device 12 from the apparatus 10. The user may be an employee of an entity (not shown in the drawings), such as, for example, a vendor, a wholesaler and/or a retailer. The entity may sell portable electronic devices, such as, the device 12. The entity may have other units of the device 12 in storage for sale. Moreover, the user may use the apparatus 10 and/or the fixture 14 to display and/or to exhibit the device 12 for sale. The present invention should not be deemed as limited to the embodiment of a specific entity.

A person (not shown in the drawings) may manipulate, may examine and/or may utilize the device 12 without detaching the device 12 from the fixture 14. The apparatus 10 may allow the person to lift the device 12 from the top surface 24 of the fixture 14 while the device 12 remains attached to the fixture 14 via the cable 20 and/or the locking member 22. Further, the apparatus 10 may allow the person to examine physical characteristics, such as, for example, weight, appearance and/or texture of the device 12 while the device 12 remains secured to the fixture 14. The person may be, for example, a potential purchaser of one of the other units of the device 12 in storage by the entity. The present invention should not be deemed as limited to the embodiment of a specific person.

Figure 3:
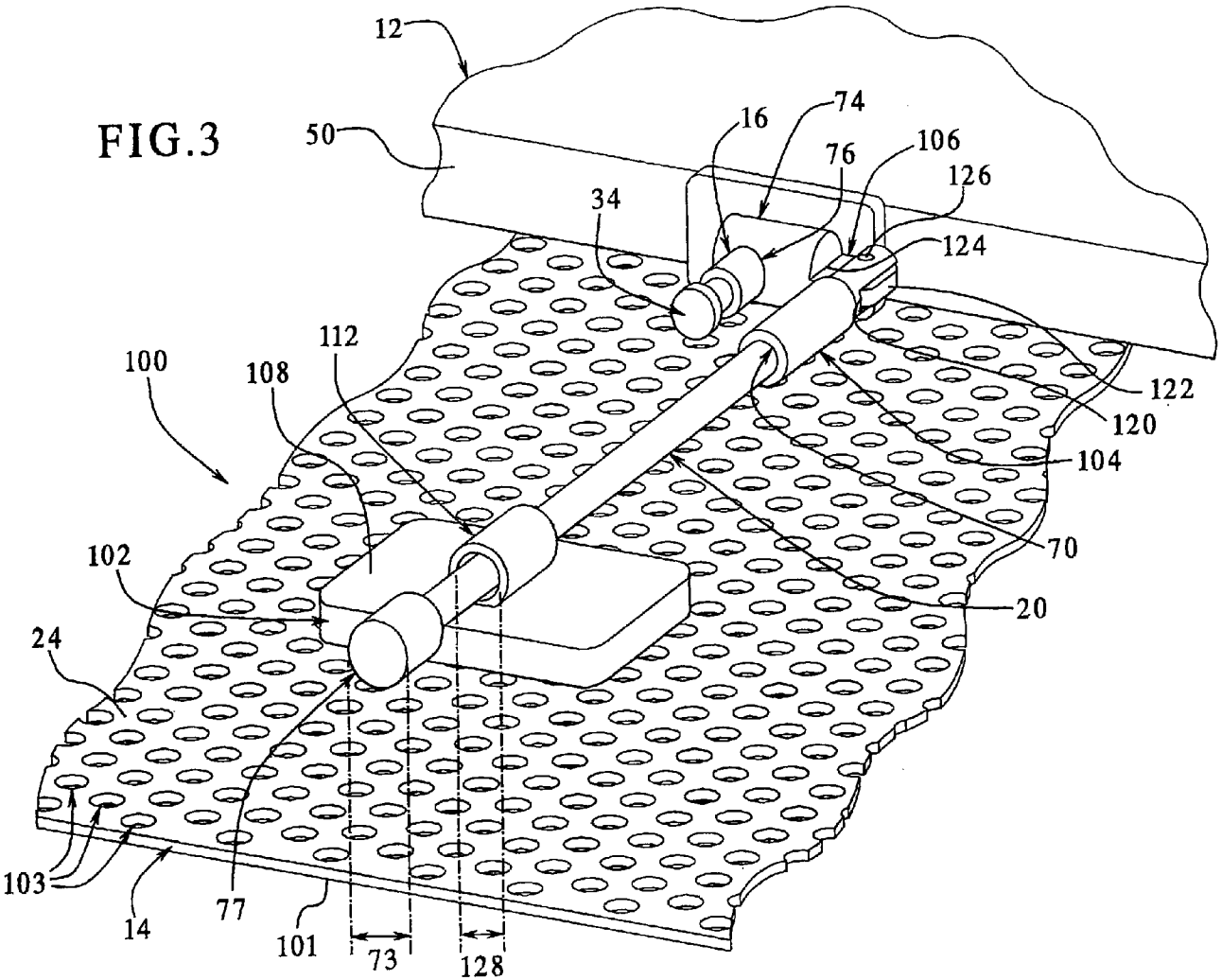
FIG. 3 is a perspective view of an apparatus for securing a device to a fixture in an embodiment of the present invention.

As illustrated in FIG. 3, an apparatus 100 which may secure the device 12 to the fixture 14 in another embodiment of the present invention. The apparatus 100 may have a base 102, a support 104 and/or a leg 106. The fixture 14 may have a bottom surface 101 and/or a plurality of holes 103. The bottom surface 101 may be opposite to the top surface 24 of the fixture 14. Each of the plurality of holes 103 may extend through the fixture 14 from the bottom surface 101 to the top surface 24 of the fixture 14.

Figure 5:
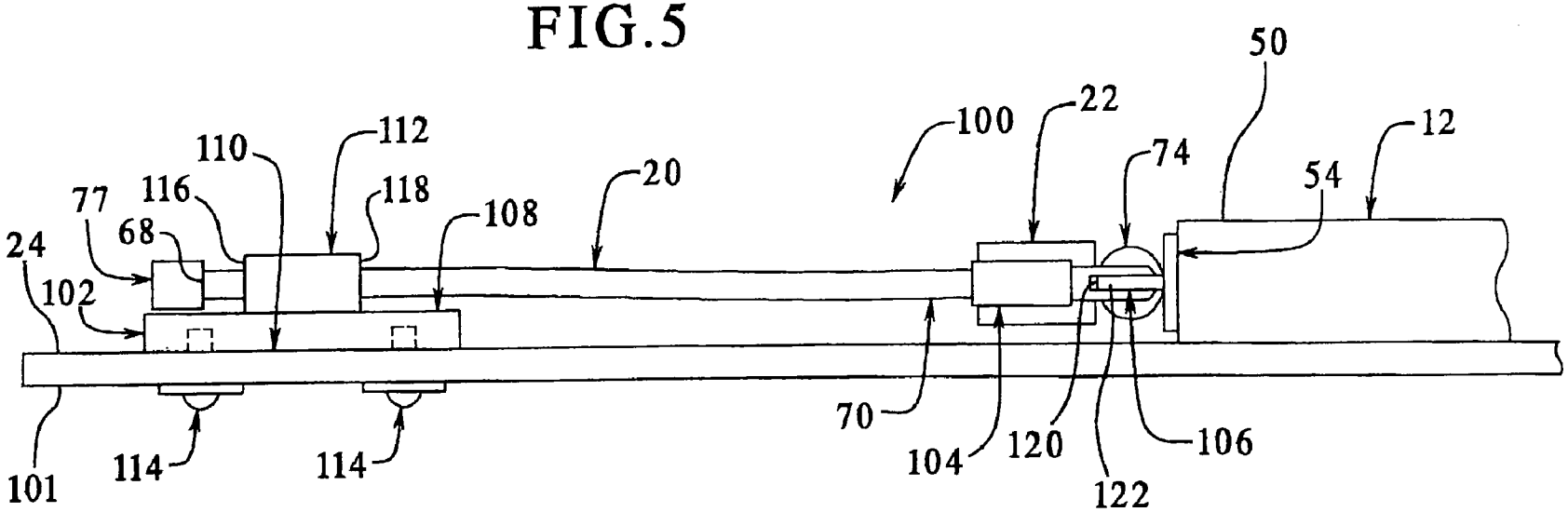
FIG. 5 is a side plan view of an apparatus for securing a device to a fixture in an embodiment of the present invention.

As best illustrated in FIG. 5, the base 102 may have a top side 108 and/or a bottom side 110. The top side 108 may be opposite to the bottom side 110. The top side 108 may have a sleeve 112 located thereon. The base 102 may be integrally formed with the sleeve 112. The sleeve 112 may have a diameter 128. As shown in FIG. 3, the diameter 128 of the apparatus 100 may be equal to the diameter 28 of the apparatus 10 as shown in FIG. 2. The base 102 may be made from a material, such as, for example, steel and/or the like. Moreover, the present invention should not be deemed as limited to a specific material of the base 102.

The base 102 may be connected to the fixture 14 via a plurality of mounts 114. Each one of the plurality of mounts 114 may be inserted into a respective one of the plurality of holes 103 of the fixture 14. Each one of the plurality of mounts 114 may extend outward with respect to the top surface 24 of the fixture 14. Each one of the plurality of mounts 114 may attach to the bottom side 110 of the base 102. As a result, the base 102 may be attached to the fixture 14. The bottom side 110 of the base 102 may be adjacent to the top surface 24 of the fixture 14. Each of the plurality of mounts 114 may be, for example, a screw, a bolt, a pin and/or the like. Each of the plurality of mounts 114 may be made from a material, such as, steel and/or the like. Moreover, the present invention should not be deemed as limited to a specific material of each of the plurality of mounts 114.

The support 104 may be attached to the second end 70 of the cable 20 as shown in FIG. 3. The support 104 may have a slot 120 therein. The leg 106 may have a first end 122 and/or a second end 124. The second end 124 may be opposite to the first end 122 of the leg 106. The first end 122 of the leg 106 may be inserted into the slot 120 in the support 104. A pin 126 may be inserted into the support 104 and/or through the first end 122 of the leg 106. As a result, the first end 122 of the leg 106 may be attached to the support 104 via the slot 120 and/or the pin 126. The leg 106 may, for example, extend outward with respect to the slot 120 of the support 104.

Figure 4:
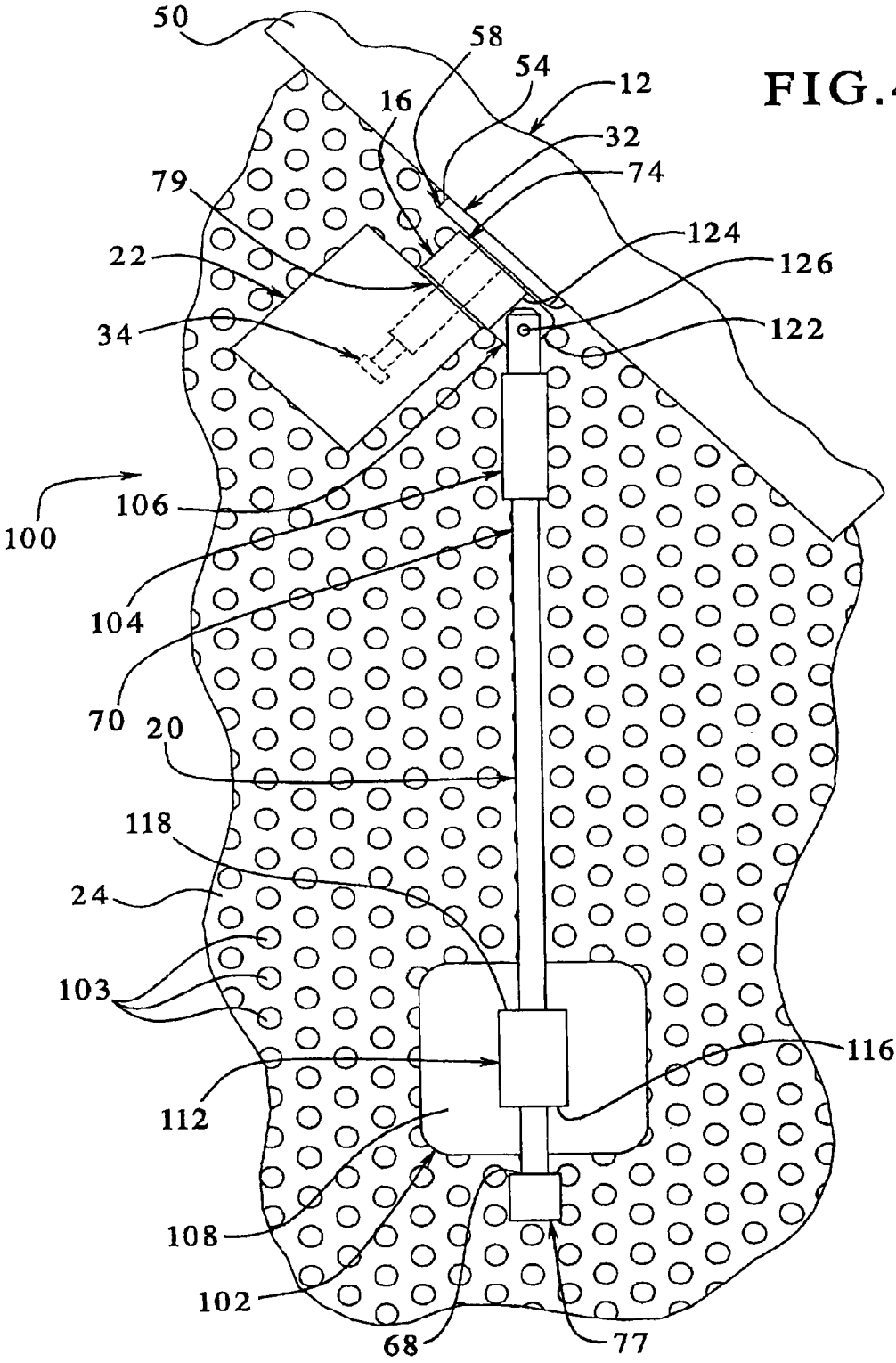
FIG. 4 is a top plan view of an apparatus for securing a device to a fixture in an embodiment of the present invention.

As illustrated in FIGS. 3 and 4, the slot 120 and/or the pin 126 may allow the second end 124 of the leg 106 to rotate with respect to the support 104 and/or the cable 20. The head 74 may be attached to the second end 124 of the leg 106. The pin 126, the leg 106 and/or the slot 120 may allow the head 74 to rotate with respect to the support 104 and/or the cable 20. The leg 106 and/or the head 74 may be rotated by a degree, such as, for example, thirty degrees, forty-five degrees or ninety degrees. The support 104 and/or the leg 106 may be made from a material, such as, for example, steel and/or the like. The present invention should not be deemed as limited to a specific degree of rotation by the leg 106 and/or a specific material of the support 104 and/or the leg 106.

The sleeve 112 of the base 102 may have a first end 116 and/or a second end 118 as shown in FIG. 5. The second end 118 may be opposite to the first end 116 of the sleeve 112. The second end 70 of the cable 20 may be inserted into the first end 116 of the sleeve 112. The cable 20 may extend through the sleeve 112 from the first end 116 to the second end 118 of the sleeve 112. The second end 70, the support 104, the leg 106 and/or the head 74 of the cable 20 may extend outward with respect to the second end 118 of the sleeve 112. As a result, the stopper 77 and/or the first end 68 of the cable 20 may be adjacent to the base 102 and/or the first end 116 of the sleeve 112. The length 72 of the cable may allow the support 104 and/or the head 74 to move inward and/or outward with respect to the second end 118 of the sleeve 112 and/or the base 102. The diameter 73 of the stopper 77 may be greater than the diameter 128 of the sleeve 112. As a result, the sleeve 112 and/or the stopper 77 may prevent the first end 68 of the cable 20 from passing through the sleeve 112 from the first end 116 to the second end 118 of the sleeve 112.

The device 12 may be attached to the arm 16 via the bracket 32 as shown in FIG. 4. The arm 16 may be inserted through the passage 66 of the housing 18. The front side 54 and/or the recession 58 of the housing 18 may be adjacent to the device 12 and/or the bracket 32 of the arm 16. Further, the tip 34 of the arm 16 may extend outward with respect to the device 12 and/or the housing 18. Still further, the tip 34 of the arm 16 may be inserted through the opening 76 of the head 74 as shown in FIG. 3. Moreover, the tip 34 may be inserted into the lock hole 79 of the locking member 22. The tip 34 may be locked into the locking member 22. The device 12 may be attached to the locking member 22, the head 74, the leg 106, the support 104, the cable 20 and the base 102 via the sleeve 112. As a result, the device 12 may be secured to the fixture 14.

The user may use the apparatus 100 to secure and/or to attach the device 12 to the fixture 14. Further, the user may attach and/or may lock the device 12 to the apparatus 100 via the arm 16 and/or the locking member 22. Still further, the user may attach the apparatus 100 and/or the device 12 to the fixture 14 via the cable 20, the base 102, the sleeve 112 of the base 102, the plurality of mounts 114 and/or the plurality of holes 103 in the fixture 14. Moreover, the user may detach the locking member 22, the device 12 and/or the apparatus 100 from the fixture 14.

The person may utilize the apparatus 100 to manipulate, to examine and/or to utilize the device 12 without detaching the device 12 from the fixture 14. Further, the apparatus 100 may allow the person to lift the device 12 from the top surface 24 of the fixture 14 while the device 12 remains attached to the fixture 14 via the cable 20. Still further, the apparatus 10 may allow the person to examine the physical characteristics of the device 12 while the device 12 remains secured to the fixture 14 via the cable 20.

Figure 6:
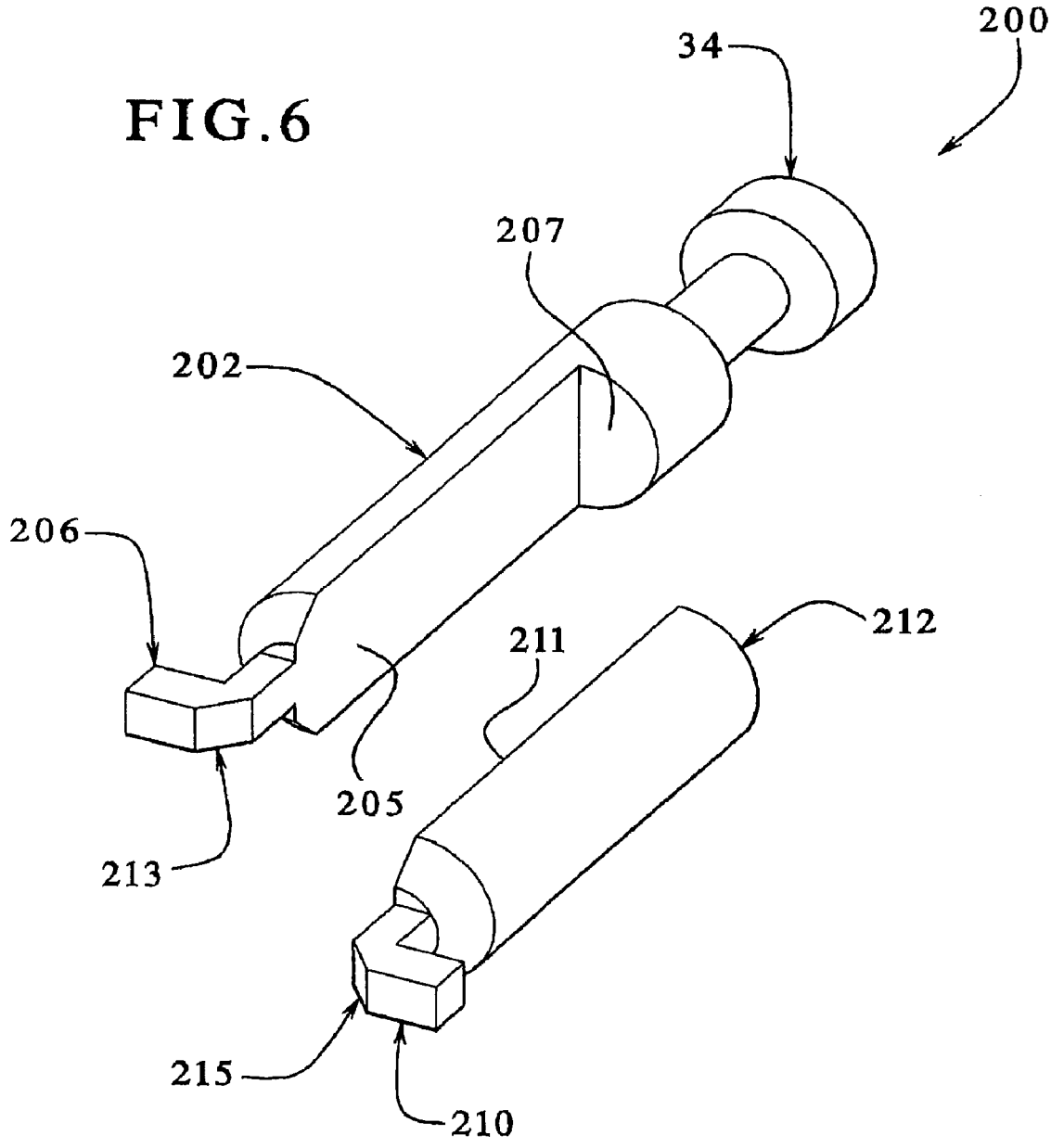
FIG. 6 is a perspective view of an anchor assembly for securing a device to a fixture in an embodiment of the present invention.

FIG. 6 illustrates an anchor assembly 200 which may secure the device 12 to the fixture 14 in an embodiment of the present invention. The anchor 200 may have a first finger 202 and/or a second finger 204. The first finger 202 may have a first hook 206, a first surface 205, second surface 207, a first chamfer 213 and/or the tip 34. The tip 34 may be opposite to the first hook 206. The second finger 204 may have a second hook 210, a surface 211, a second chamfer 215 and/or an end 212. The end 212 may be opposite to the second hook 210. The second finger 204 may align with the first finger 202 to form the anchor assembly 200. The surface 211 of the second finger 212 may abut the first surface 205 of the first finger 202. The end 212 of the second finger 204 may abut the second surface 207 of the first finger 202. The user may combine the first finger 202 with the second finger 204 to form the anchor assembly 200. The first finger 202 and/or the second finger 204 may be made from a material, such as, for example, steel and/or the like. The present invention should not be deemed as limited to a specific material of the first finger 202 and/or the second finger 204.

Figure 7:
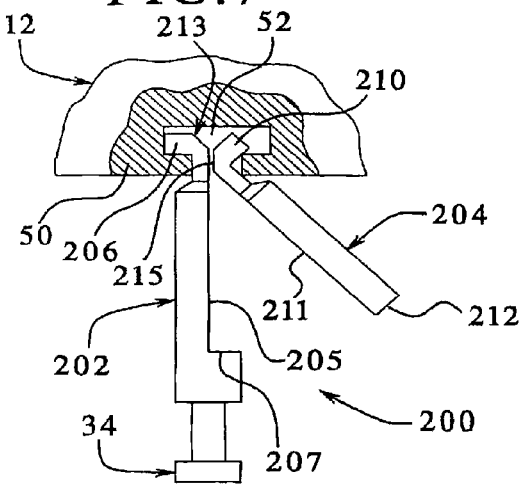
FIG. 7 is a perspective view of an anchor assembly being inserted into a port of a device in an embodiment of the present invention.

As illustrated in FIG. 7, the first hook 206 of the first finger 202 may be inserted into a port 52 on the exterior 50 of the device 12. The second hook 210 of the second finger 204 may be inserted into the port 52 of the device 12. The second chamfer 215 of the second finger 204 may allow the second hook 210 of the second finger 204 to enter the port 52. The second chamfer 215 of the second finger 204 may be adjacent to the first hook 206 of the first finger 202. The tip 34 may extend outward with respect to the port 52 of the device 12.

Figure 8:
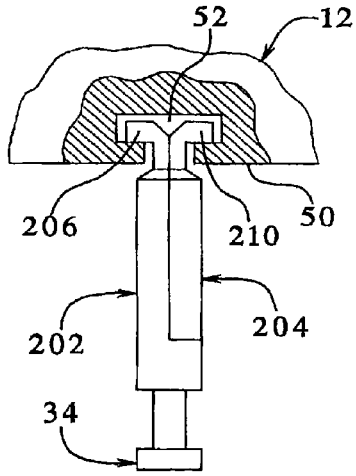
FIG. 8 is a perspective view of an anchor assembly attached to a device in an embodiment of the present invention.

As illustrated in FIG. 8, the first finger 202 and the second finger 204 may form the anchor 200. The second finger 204 may be pushed inward with respect to first finger 202 by the user. The surface 211 of the second finger 204 may abut the first surface 205 of the first finger 202. The end 212 of the second finger 204 may abut the second surface 207 of the first finger 204. The first finger 202 may combine with the second finger 204 to form the anchor assembly 200. As a result, the anchor assembly 200 may be attached to the device 12 via the port 54 of the device 12.

Figure 9:
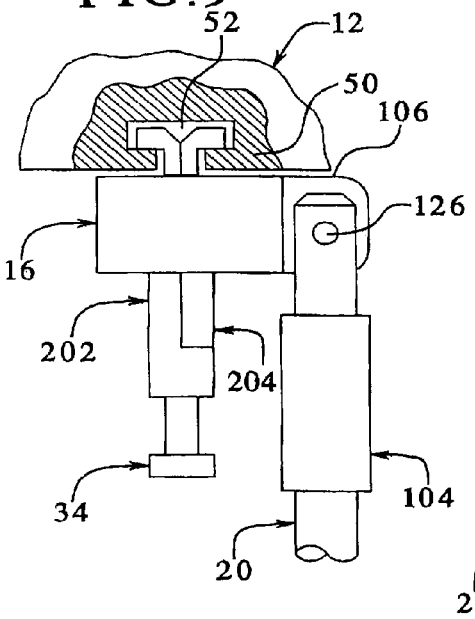
FIG. 9 is a perspective view of an apparatus assembly for securing a device to a fixture in an embodiment of the present invention.

As illustrated in FIG. 9, the anchor assembly 200 may be inserted into the opening 76 of the head 74. The tip 34 of the first finger 202 may be inserted into the opening 76 of the head 74. The head 74 may be adjacent to the first hook 206, the second hook 210, the port 54 and/or the device 12. As a result, the tip 34 of the first finger 202 may extend outward with respect to the head 74 and/or the device 12.

Figure 10:
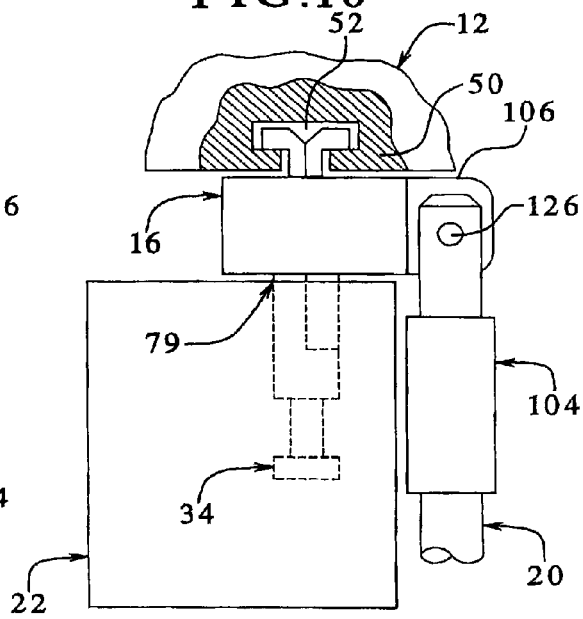
FIG. 10 is a perspective view of an apparatus assembly securing a device to a fixture in an embodiment of the present invention.

As illustrated in FIG. 10, the anchor assembly 200 may be inserted into the lock hole 79 of the locking member 22. The tip 34 of the first finger 202 may be inserted into the lock hole 79 of the locking member 22. The tip 34 may be locked into the locking member 22. As a result, the anchor assembly 200 may be locked into the locking member 22. The device 12 may be locked to the head 74 via the locking member 22. As a result, the device 12 may be attached to the fixture 14, the base 102 or the opening 31 in the fixture 14 via the cable 20 and/or the stopper 77. Moreover, the device 12 may be secured to the fixture 14 via the anchor assembly 200, the locking member 22, the head 74, the cable 20 and/or the stopper 77.

The apparatus 10 and/or the apparatus 100 may secure and/or may attach the device 12 to the fixture 14. The anchor assembly 200 or the first connector 46 and/or the second connector 48 may attach the device 12 to the head 74, the cable 20 and/or the fixture 14. The first connector 46 and/or the second connector 48 may attach the device 12 to the bracket 32 of the arm 16. The tip 34 of the arm 16 or of the first finger 202 may pass through the head 74 via the opening 76 of the head 74. The tip 34 may be inserted into the lock hole 79 and/or locked into the locking member 22. The head 74 may be attached to the fixture 14 via the cable 20. As a result, the device 12 may be attached to and/or may be secured to the fixture 14.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An apparatus for securing a device to a fixture wherein the device is portable and the fixture is secured to another surface, the apparatus comprising:

a base having a front side and a backside wherein the backside is positioned opposite to the front side wherein the base has a plurality of holes;

a first plurality of connectors wherein each of the plurality of connectors has a length defined between a first end and a second end wherein each of the first plurality of connectors are sized to be inserted into the plurality of holes of the base wherein the first end of each of the first plurality of connectors extend outwardly with respect to the front side of the base wherein the first end of each of the first plurality of connectors attaches the base to the fixture;

a bracket attached to the device;

a cable having a length defined between a first end and a second end wherein the cable connects the bracket to the base wherein the first end of the cable is attached to the bracket and the second end of the cable is attached to the base;

a leg connected to the first end of the cable wherein the leg rotates relative to the cable and further wherein the leg has a hole, a first side and a second side wherein the second side is positioned opposite to the first side wherein the hole extends from the first side of the leg through the leg to the second side of the leg;

an arm extending from the bracket through the hole in the leg wherein rotation of the leg relative to the cable causes the device to rotate relative to the cable; and a lock attached to the arm wherein the leg is located between the device and the lock wherein attachment of the lock to the arm maintains a position of the arm within the hole of the leg.

2. The apparatus of claim 1 further comprising:

a slot in the first end of the cable wherein the leg is connected to the slot in the first end of the cable.

3. The apparatus of claim 1 further comprising:

a stopper attached to the second end of the cable.

4. The apparatus of claim 1 further comprising:

a second plurality of connectors attaching the bracket to the device.

5. The apparatus of claim 1 further comprising:

a sleeve on the base wherein the sleeve has a passageway and the first end of the cable inserts through the passageway of the sleeve.

6. The apparatus of claim 1 further comprising:

a pin connecting the cable to the leg.

7. The apparatus of claim 1 further comprising:

a plurality of mounts attaching the bracket to the fixture.

8. A method for displaying a device on a fixture having a surface, the method comprising the steps of:

providing a bracket having a front side, a backside and an arm wherein the front side is positioned opposite to the backside and further wherein the arm extends outward with respect to the backside wherein the arm has a length defined between a tip and an end wherein the end of the arm is adjacent to the backside of the bracket wherein the bracket has an opening extending from the front side of the bracket through the bracket to the backside of the bracket;

inserting a connector into the opening of the bracket wherein the connector has a length defined between a first end of the connector and the second end of the connector wherein the second end of the connector is adjacent to the backside of the bracket wherein the first end of the connector extends outwardly with respect to the front side of the bracket wherein the first end of the connector attaches the bracket to the device wherein the front side of the bracket is adjacent to the device;

connecting a cable to the arm wherein the cable has a length defined between a first end of the cable and a second end of the cable wherein the first end of the cable is connected to a leg to rotate the leg relative to the cable wherein the cable is connected to the arm by the leg wherein rotation of the leg relative to the cable causes the device to rotate relative to the cable;

attaching a lock to the arm wherein the cable connects to the arm between the lock and the bracket and further wherein the lock secures the device to the cable; and connecting the second end of the cable to the fixture.

9. The method of claim 8 further comprising the step of:

setting the device on the surface of the fixture.

10. The method of claim 8 further comprising the step of:

removing the lock from the arm.

11. The method of claim 8 further comprising the step of:

forming a passageway in the leg wherein the leg has a first side and a second side wherein the second side is in a position opposite to the first side wherein the passageway extends from the first side of the leg through the leg to the second side of the leg wherein the device is connected to the leg by insertion of the arm through the passageway.

12. The method of claim 8 further comprising the steps of:

mounting a sleeve on the fixture wherein the sleeve has a first end, a second end and an opening wherein the opening extends from the first end through the sleeve to the second end; and attaching the cable to the fixture by inserting the first end of the cable through the opening of the sleeve and extending the cable through the opening to the second end of the sleeve.

13. An apparatus for attaching a device to a fixture wherein the device is portable and the fixture is secured to another surface, the apparatus comprising:

a cable having a diameter, a first end and a second end wherein the second end is opposite to the first end and further wherein the second end has a stopper having a diameter wherein the diameter of the stopper is greater than the diameter of the cable wherein the first end of the cable has a slot;

a sleeve having a length defined between a first end of the sleeve and a second end of a sleeve wherein the sleeve has an opening extending from the first end of the sleeve through the sleeve to the second end of the sleeve wherein the opening of the sleeve has a diameter wherein the diameter of the sleeve is greater than the diameter of the cable and is less than the diameter of the stopper wherein the cable is inserted into the opening wherein the second end of the cable extends outwardly with respect to the second end of the sleeve wherein the stopper of the cable is adjacent to the second end of the sleeve wherein attachment of the second end of the cable to the sleeve connects the second end of the cable to the fixture;

a leg inserted into the slot in the first end of the cable wherein the leg rotates relative to the cable;

an opening in the leg wherein the opening extends through the leg; and an attaching means having a first end and a second end wherein the second end is in a position opposite to the first end and further wherein the attaching means is inserted into the opening in the leg wherein the first end of the attaching means extends away from the cable and further wherein the device attaches to the first end of the attaching means wherein the leg rotates relative to the cable to cause rotation of the device relative to the cable.

14. The apparatus of claim 13 further comprising:

a plurality of connectors that connect the first end of the attaching means to the device.

15. The apparatus of claim 13 further comprising:

a pin between the leg and the first end of the cable.

16. The apparatus of claim 13 further comprising:

a lock attached to the second end of the attaching means wherein the leg resides between the lock and the device and the lock maintains insertion of the arm through the opening of the leg.

* * * * *